US012129622B2

(12) United States Patent
Wang et al.

(10) Patent No.: US 12,129,622 B2
(45) Date of Patent: Oct. 29, 2024

(54) ROOT-LIKE EXPANDABLE FOUNDATION PILE

(71) Applicant: A&C Future, Inc., Newport Beach, CA (US)

(72) Inventors: Jiuqi Wang, Santa Ana, CA (US); Keguan Zou, Irvine, CA (US); Han Qin, Newport Beach, CA (US); Zhuangboyu Zhou, Santa Ana, CA (US); Sichen Li, Santa Ana, CA (US); Jiayang Qin, Newport Beach, CA (US); Xunmin Jiang, Irvine, CA (US); Ju Gao, Newport Beach, CA (US)

( * ) Notice: Subject to any disclaimer, the term of this patent is extended or adjusted under 35 U.S.C. 154(b) by 288 days.

(21) Appl. No.: 17/943,478

(22) Filed: Sep. 13, 2022

(65) Prior Publication Data

US 2024/0084539 A1 Mar. 14, 2024

(51) Int. Cl.

*E02D 5/22* (2006.01)
*E02D 5/54* (2006.01)
*E02D 5/56* (2006.01)

(52) U.S. Cl.

CPC ..... *E02D 5/223* (2013.01); *E02D 5/54* (2013.01); *E02D 5/56* (2013.01); *E02D 2600/30* (2013.01)

(58) Field of Classification Search

CPC .. E02D 5/223; E02D 5/54; E02D 5/56; E02D 5/803; E02D 7/22; E02D 2600/30
USPC ..... 405/237, 238
See application file for complete search history.

(56) References Cited

U.S. PATENT DOCUMENTS 3,324,666 A * 6/1967 Lee ..... E02D 5/72 114/305
3,938,344 A * 2/1976 Asayama ..... E02D 5/48 175/171
4,015,433 A * 4/1977 Shibata ..... E02D 5/54 405/259.5
4,189,879 A * 2/1980 Patterson ..... E02D 5/803 52/161
4,593,500 A * 6/1986 Watson ..... E02D 5/803 52/155
5,503,501 A * 4/1996 Kunito ..... E02D 5/36 405/269

FOREIGN PATENT DOCUMENTS

KR 101055744 B1 * 8/2011
KR 20150055191 A * 5/2015

* cited by examiner

*Primary Examiner* — Kyle Armstrong
(74) *Attorney, Agent, or Firm* — Tommy S F Wang; Wang IP Law Group, P.C.

(57) ABSTRACT

A root-like expandable foundation pile is disclosed. It includes a movable drill, a foundation body, a number of foundation blade, a foundation cap and a stopper. The foundation blades are designed to have the warped portion protruding outward, so that they can expand outward by rotating the root-like expandable foundation pile in a direction different from that makes the root-like expandable foundation pile drilled into the soil. Extra bearing capacity can be available from the expanded foundation blades. Time and cost of installation can both be saved.

11 Claims, 16 Drawing Sheets

ROOT-LIKE EXPANDABLE FOUNDATION PILE

FIELD OF THE INVENTION

The present application relates to a foundation pile. More particularly, the present application relates to a root-like expandable foundation pile.

BACKGROUND OF THE INVENTION

For any construction, a good design of a foundation supporting it is very important. The foundation distributes the weight from the construction into the nearby soil or rock, so that the construction can be held firmly and free from settlement. The types of foundation can be divided into shallow foundation and deep foundation. The former transfers the weight of the construction directly to the soil beneath it. The latter transfers the weight of the construction to the deep solid. Pile foundation is the one that can be used as both hallow foundation and deep foundation.

For a light construction, such as a house, when piles are used as the function, the size of the piles may not huge. However, it does not mean that it is easy to install the piles. Usually, the piles are driven into the ground by hammers (labor) or vibratory drivers (machine). In special circumstances, pile can also be inserted by jetting or partial angering. Obviously, installation of the pile is time consuming and costly. On the other hand, bearing capacity of piles comes from the support force at the pile tip and the skin friction developed at the side of the pile. For a short pile for a house, skin friction is limited. If the support force at the pile tip is not enough, settlement of the house is possible. A way to increase the support force is to increase the cross-sectional area at the pile tip. However, a driven pile cannot do this.

In order to save the time and cost of installation of piles and increase the bearing capacity, a root-like expandable foundation pile is invented and disclosed.

SUMMARY OF THE INVENTION

This paragraph extracts and compiles some features of the present application; other features will be disclosed in the follow-up paragraphs. It is intended to cover various modifications and similar arrangements included within the spirit and scope of the appended claims.

In order to settle the problems mentioned above, a root-like expandable foundation pile is disclosed. The root-like expandable foundation pile comprises: a movable drill, comprising: a control rod, having a guide bar parallelly formed thereon; and a conical drill bit, fixed on the end of the control rod, moving soil from a tip end to a tail end when being pushed and rotated in a first direction by the control rod; a foundation body, comprising: a bottom portion, having a circular cross-sectional shape; and a top portion, having a plurality of first upright sides and a regular polygon cross-sectional shape, wherein each first upright side has a first knuckle formed on a top side thereof, a first through hole is formed through the bottom portion and the top portion in the center of the foundation body, and the control rod is inserted in the first through hole, capable of moving along and out of the first through hole and being rotated synchronously with the foundation body; a plurality of foundation blade, each having two second knuckles on a swivel end and a warped portion protruding outward at an expanding end, being rotatably connected to the top portion by running a knuckle pin through the second knuckles and one of the first knuckles, being close to one corresponding first upright side by soil pressure exerted on an external side of the warped portion when the foundation body rotates in the first direction, and being rotated to expand from the corresponding first upright side by soil pressure exerted on an internal side of the warped portion when the foundation body rotates in a second direction opposite to the first direction; and a foundation cap, fixed on the top portion, having an outward appearance of a hollow cylinder with a plurality of connecting columns, each connected to the top portion where central lines of adjacent two knuckle pins are intersected.

According to the present application, an internal section shape of the foundation cap is the same as the regular polygon cross-sectional shape, a plurality of grooves are formed on a bottom side of the foundation cap, and each groove is parallel to one corresponding side of the internal section shape of the foundation cap and used to make a room for fixing to the first knuckle and the two second knuckles connected by the same knuckle pin.

The root-like expandable foundation pile further comprises a stopper having an outward appearance of a column with an external section shape the same as the regular polygon cross-sectional shape, tightly mounted inside the foundation cap. The stopper has a plurality of second upright sides, and two indentations are formed on a bottom end of each second upright side.

According to the present application, the second knuckle may further have a limit prism formed thereon, and the limit prism rotates with the second knuckle, passing through the indentation and being stopped by touching a top surface of the top portion, so that the foundation blade reaches the maximum of expansion.

According to the present application, a second through hole is formed through the stopper in the center thereof, and the control rod is inserted in the second through hole, capable of moving along and out of the second through hole and being rotated synchronously with the stopper. The second through hole may further have a second limit portion for accommodating the guide bar.

According to the present application, the first through hole may further have a first limit portion for accommodating the guide bar, so that when the foundation body rotates, the movable drill synchronously rotates due to the first limit portion pushing the guide bar to rotate.

Preferably, an external side of the foundation blade, except the warped portion, is an arc surface.

Preferably, an internal side of the foundation blade, except the warped portion, is a flat surface.

According to the present application, a number of the foundation blades is the same as that of the first upright sides. The regular polygon cross-sectional, shape is regular triangle, square, regular pentagon, regular hexagon or regular octagon.

The foundation blades are designed to have the warped portion protruding outward, so that they can expand outward by rotating the root-like expandable foundation pile in a direction different from that makes the root-like expandable foundation pile drilled into the soil. Extra bearing capacity can be available from the expanded foundation blades. Time and cost of installation can both be saved.

DETAILED DESCRIPTION OF THE PREFERRED EMBODIMENTS

The present application will now be described more specifically with reference to the following embodiments.

Figure 1:
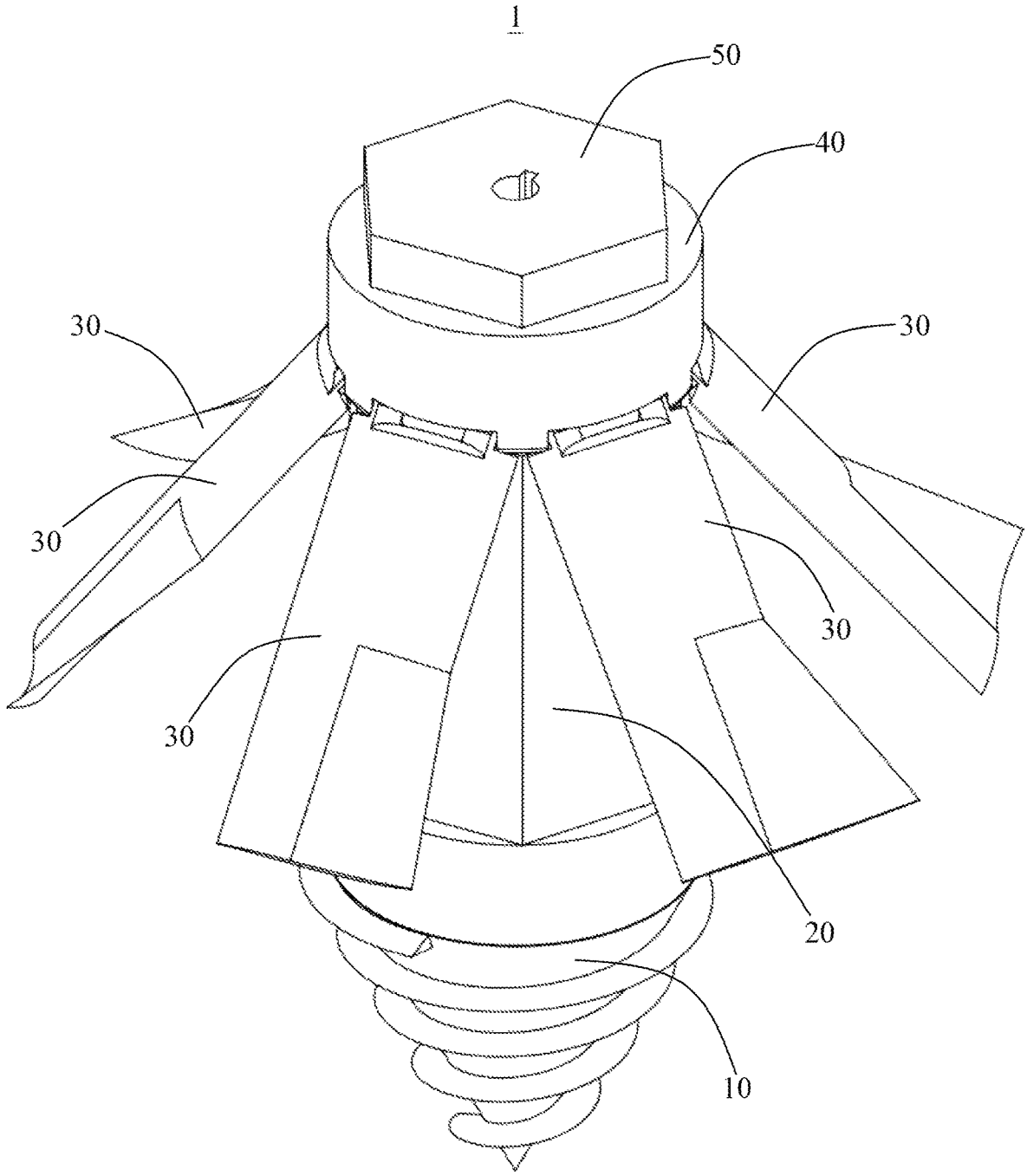
FIG. 1 is a stereogram of a root-like expandable foundation pile in an expanded status according to the present application.
Figure 2:
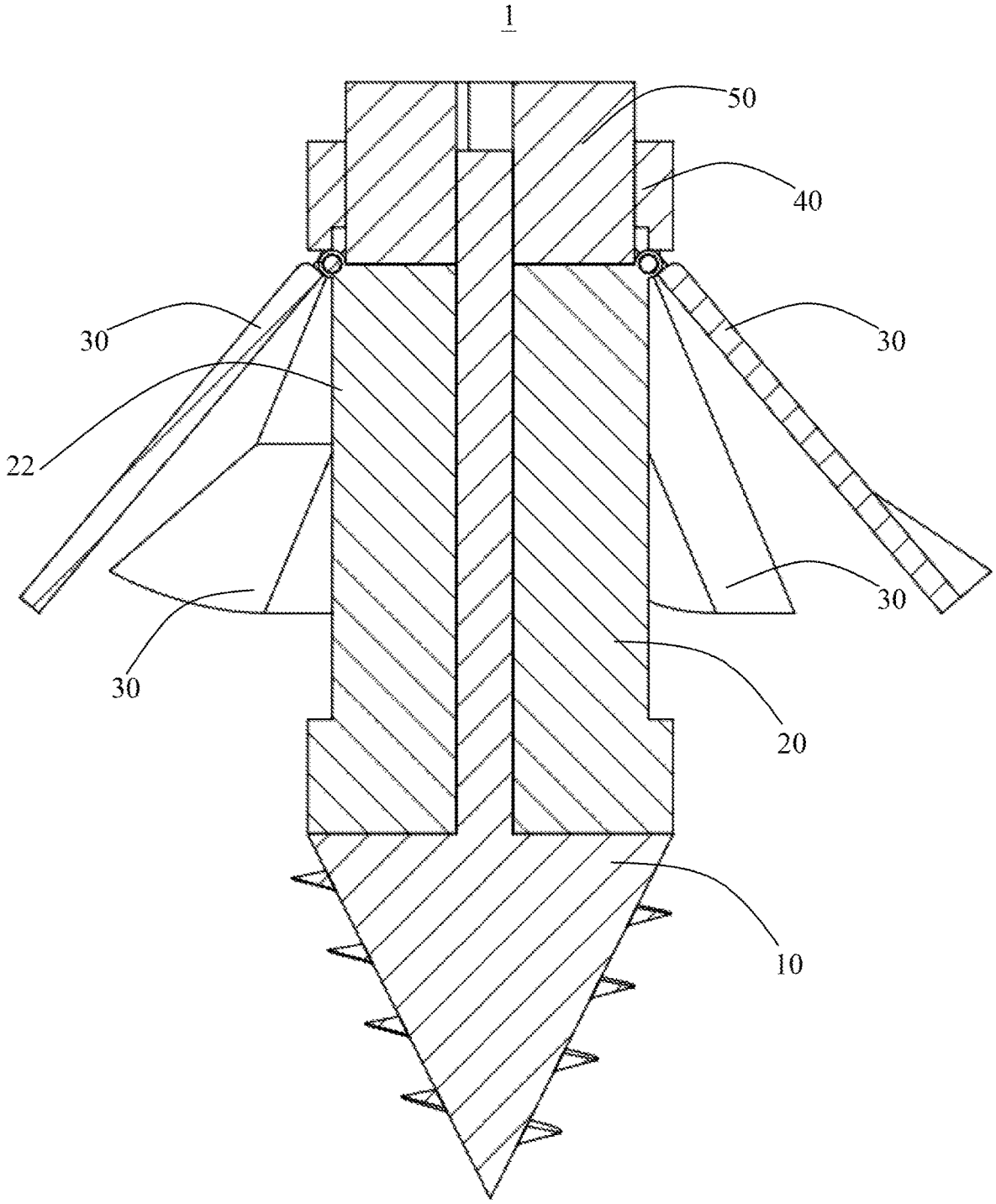
FIG. 2 is a sectional view of the root-like expandable foundation pile in the expanded status.
Figure 3:
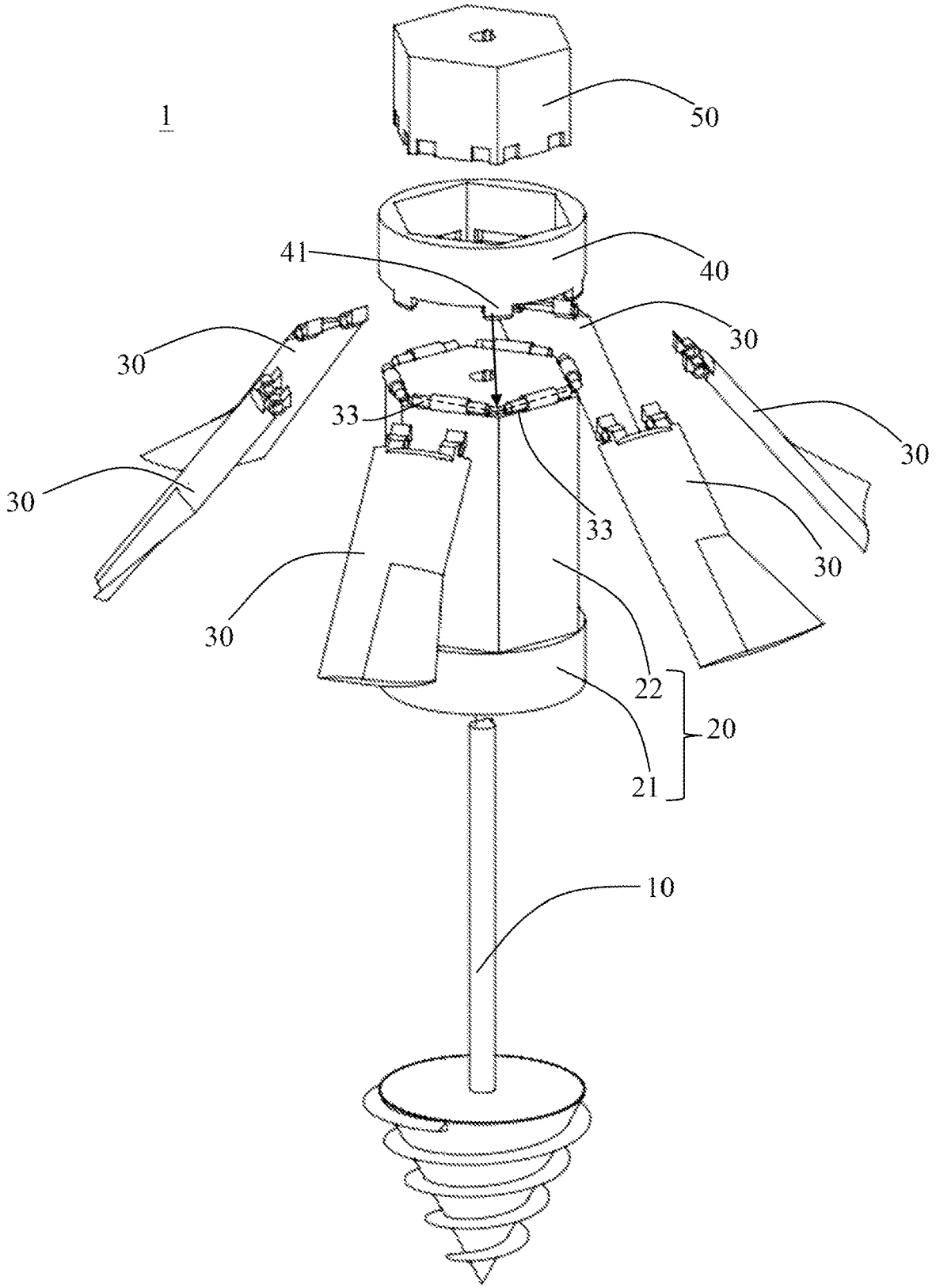
FIG. 3 is an exploded diagram of the root-like expandable foundation pile.

Refer to FIG. 1 to FIG. 3. FIG. 1 is a stereogram of a root-like expandable foundation pile 1 in an expanded status according to the present application, FIG. 2 is a sectional view of the root-like expandable foundation pile 1 in the expanded status and FIG. 3 is an exploded diagram of the root-like expandable foundation pile 1. The root-like expandable foundation pile 1 includes a movable drill 10, a foundation body 20, a number of foundation blade 30, a foundation cap 40 and a stopper 50. Structure, appearance, functions and material used are described in detail below.

Figure 4:
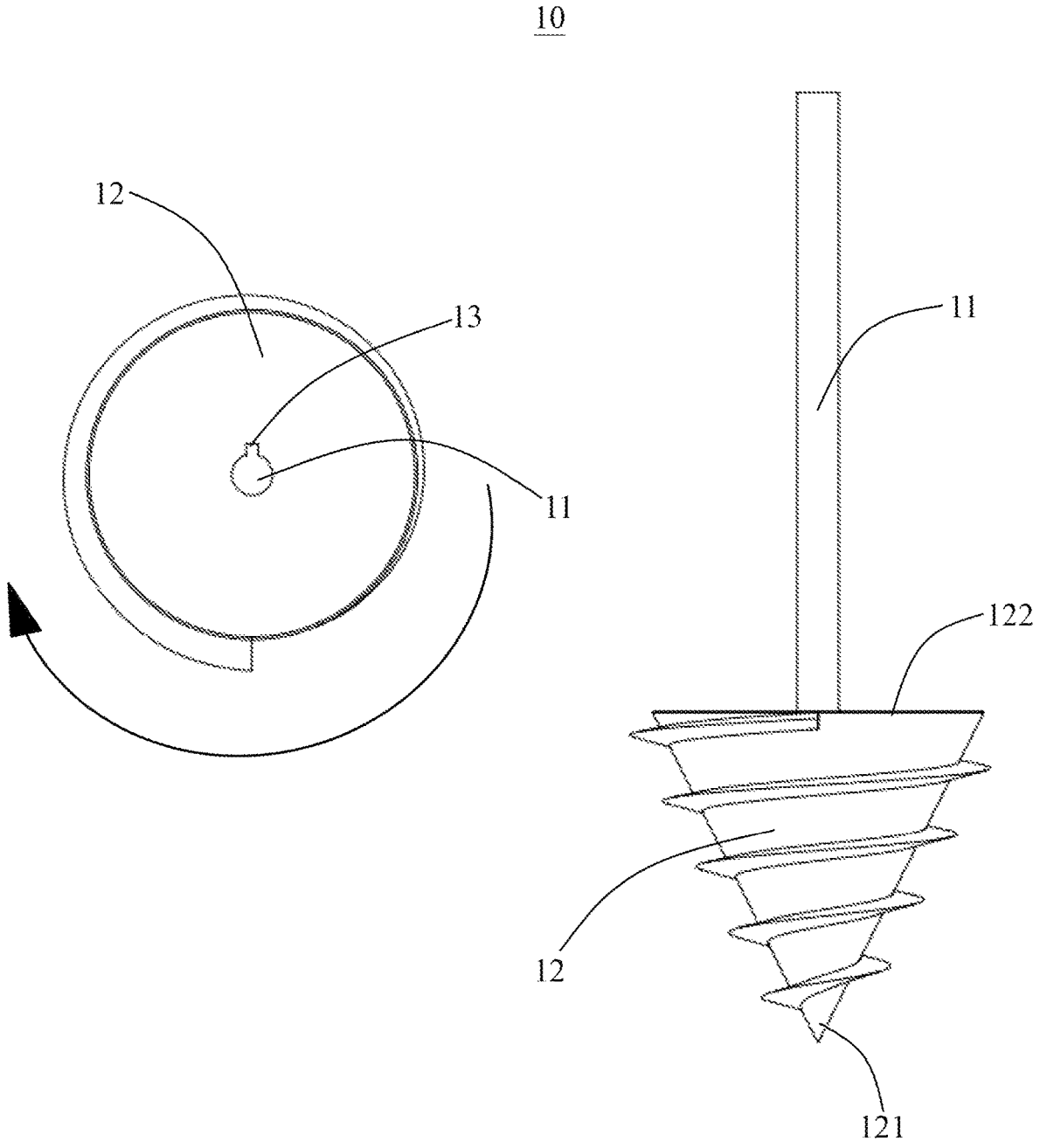
FIG. 4 illustrates a movable drill in a top view and a side view.

The movable drill 10 is a tool to drill the earth and leads the root-like expandable foundation pile 1 to a predetermined depth. The movable drill 10 has several technical features: it is movably connected on the foundation body 20 rather than fixed around the foundation body; it can be discarded for grouting concrete to improve bearing capacity; and a distance between the movable drill 10 and the foundation body 20 is adjustable. See FIG. 4. FIG. 4 illustrates the movable drill 10 in a top view (left) and a side view (right). Structure of the foundation body 20 comprises two portions: a control rod 11 and a conical drill bit 12. The control rod 11 is an element to movably connect the movable drill 10 to the foundation body 20. From the top view, a main body of the movable drill 10 is a round rod. The movable drill 10 further has a guide bar 13 parallelly formed on it. Therefore, a sectional view of the movable drill 10 like a sectional view of a key. The conical drill bit 12 is fixed on the end of the control rod 11. When the conical drill bit 12 is pushed and rotated in a first direction (shown by a curved arrow line) by the control rod 11, it can move soil from a tip end 121 to a tail end 122. The first direction from the top view is clockwise. It is a common technique for those skilled in the art to design the control rod 11. Conversely, if the control rod 11 is rotated counterclockwise and without being pushed, it may only idle and loosen the soil around.

Figure 5:
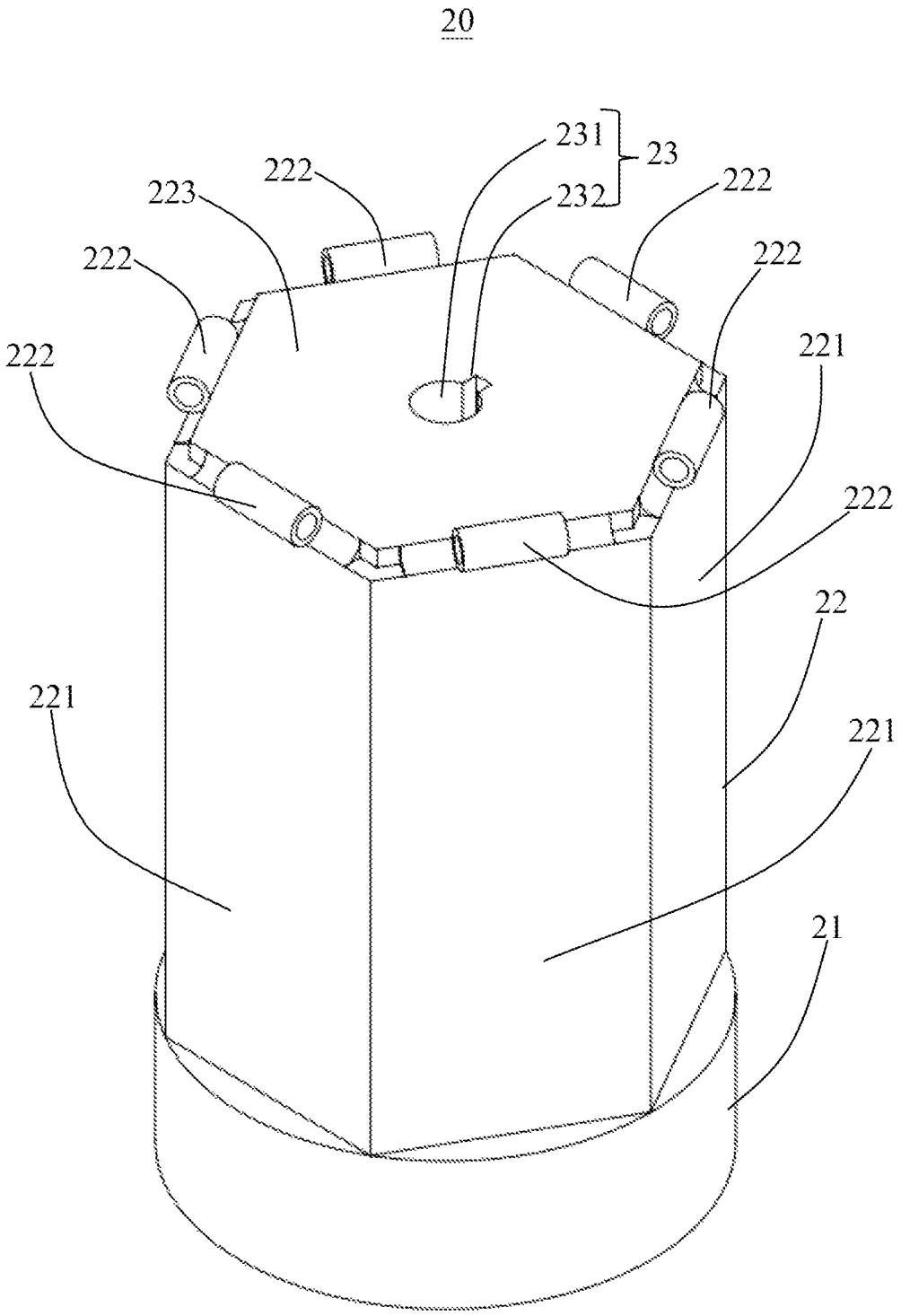
FIG. 5 is a stereogram of a foundation body.
Figure 6:
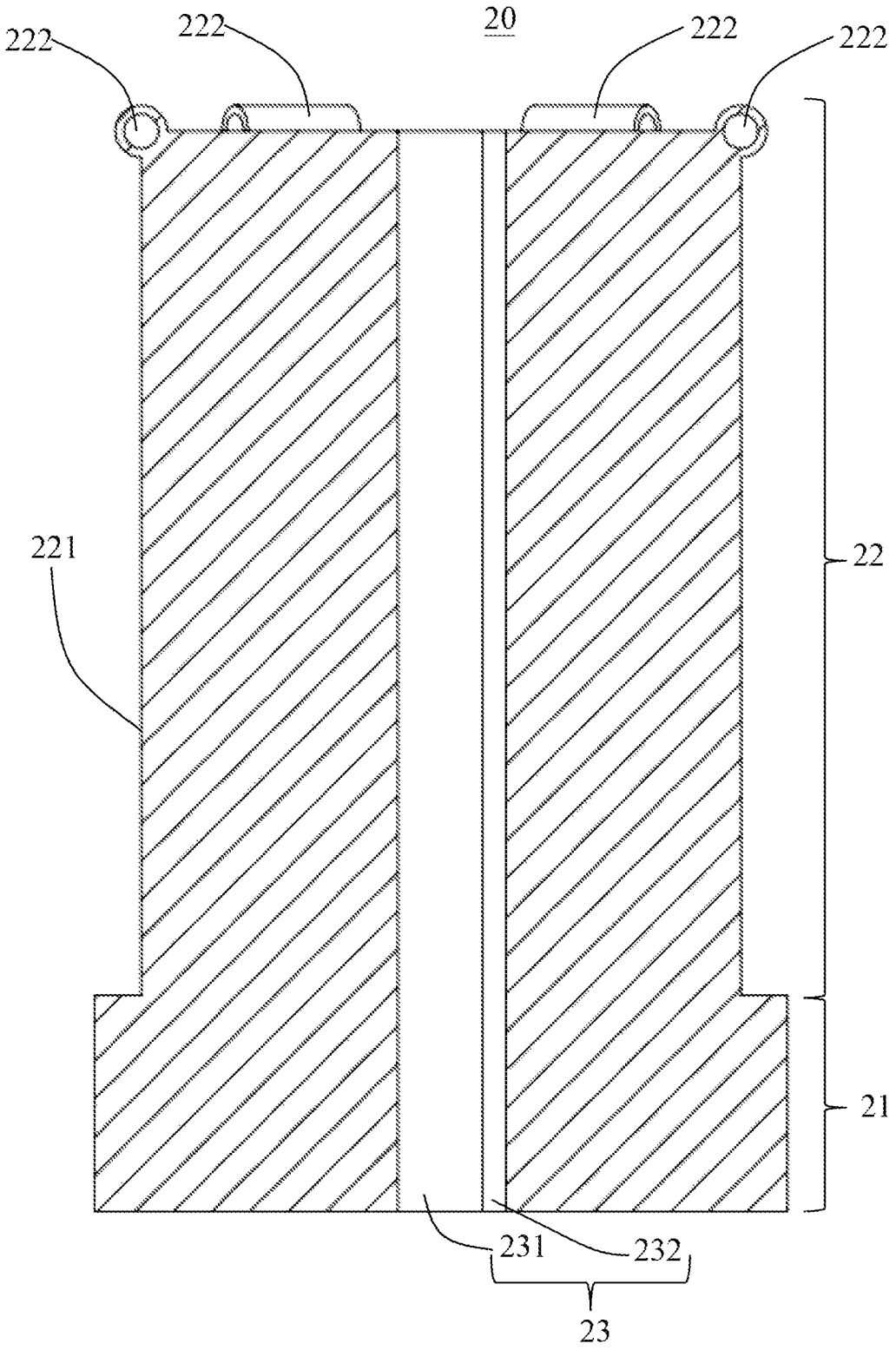
FIG. 6 is a sectional view of the foundation body.

The foundation body 20 is a main structure of the root-like expandable foundation pile 1. It connects to other components for operation. For a better understanding, please refer to FIG. 5 and FIG. 6. FIG. 5 is a stereogram of the foundation body 20 and FIG. 6 is a sectional view of the foundation body 20. The foundation body 20 has a bottom portion 21 and a top portion 22. The bottom portion 21 has a circular cross-sectional shape. The design can reduce friction from the soil when the foundation body 20 is rotated. The top portion 22 having a number of first upright sides 221. Shapes of the upright sides 221 are identical and two adjacent first upright sides 221 are arranged in a fixed angle. Therefore, the first upright sides 221 form a regular polygon cross-sectional shape of the top portion 22. In this embodiment, there are 6 first upright sides 221 and the regular polygon cross-sectional shape is regular hexagon. According to the present application, the number of the first upright sides 221 may be more than 3. Thus, the regular polygon cross-sectional shape may also be regular triangle, square, regular pentagon, regular octagon, etc. Each first upright side 221 has a first knuckle 222 formed on a top side of the first upright side 221. Correspondingly, the number of the first knuckles 222 are 6 in the embodiment.

A first through hole 23 is formed through the bottom portion 21 and the top portion 22 in the center of the foundation body 20. The first through hole 23 has a main portion 231 and a first limit portion 232. The main portion 231 can accommodate the main body of the movable drill 10 (the portion of the round rod). The first limit portion 232 is used for accommodating the guide bar 13. Connection of the movable drill 10 and the foundation body 20 is like a key inserting to a key hole. With the design of the first limit portion 232, when the foundation body 20 rotates, the movable drill 10 can synchronously rotate due to the first limit portion 232 pushing the guide bar 13 to rotate. The control rod 11 is inserted in the first through hole 23, capable of moving along and out of the first through hole 23 and is rotated synchronously with the foundation body 20.

Figure 7:
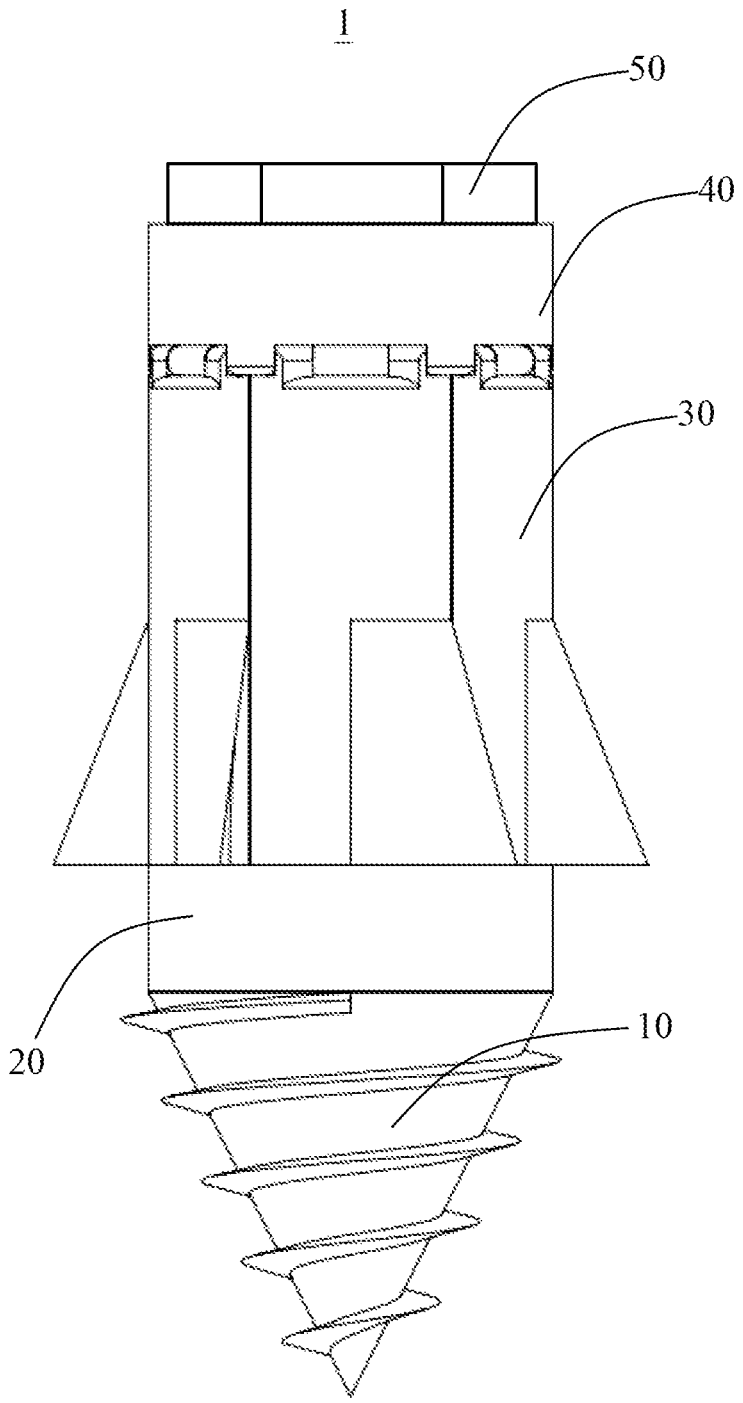
FIG. 7 is a side view of the root-like expandable foundation pile in a contracted status according to the present application.
Figure 8:
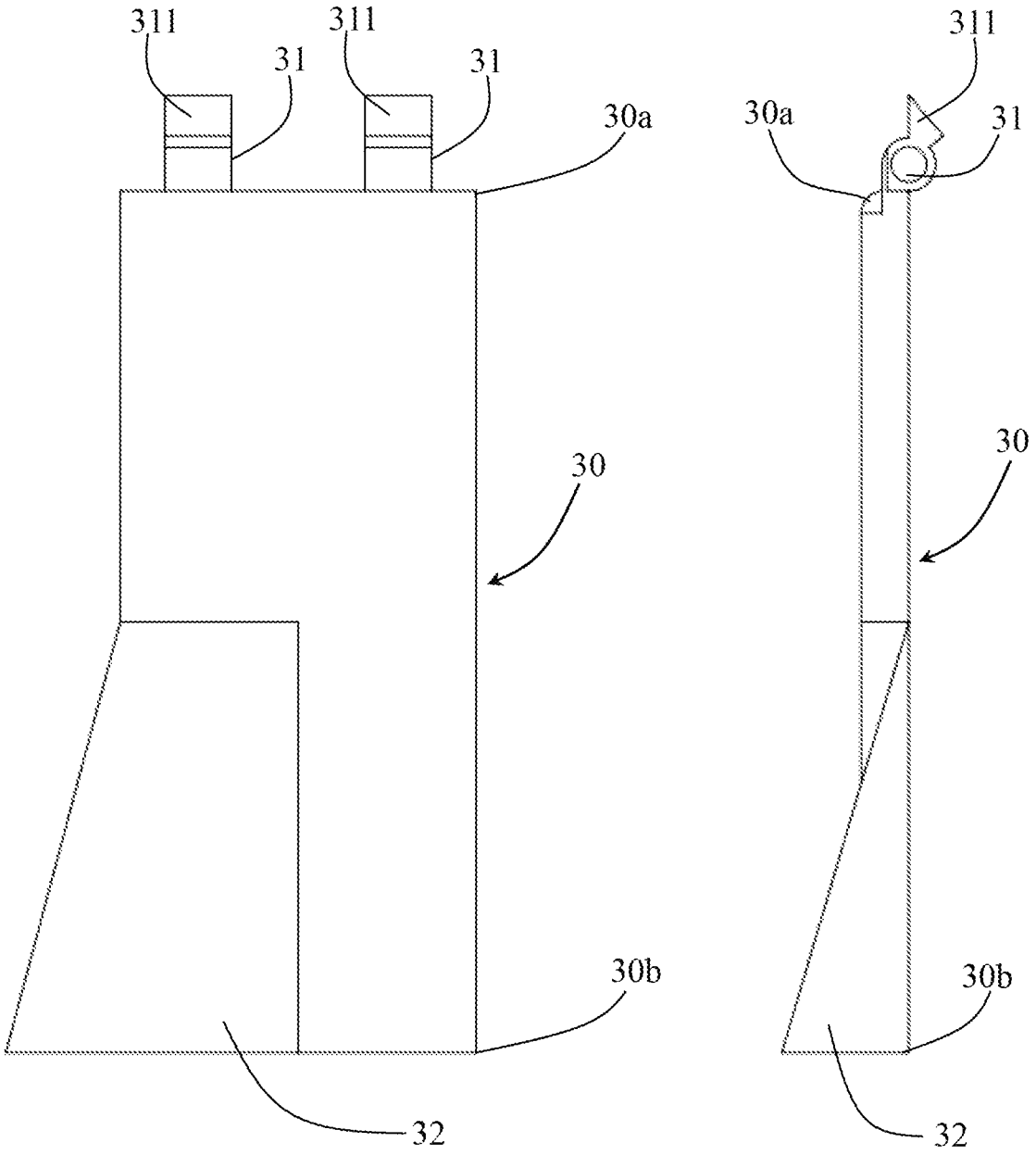
FIG. 8 illustrates a foundation blade in a front view and a side view.
Figure 9:
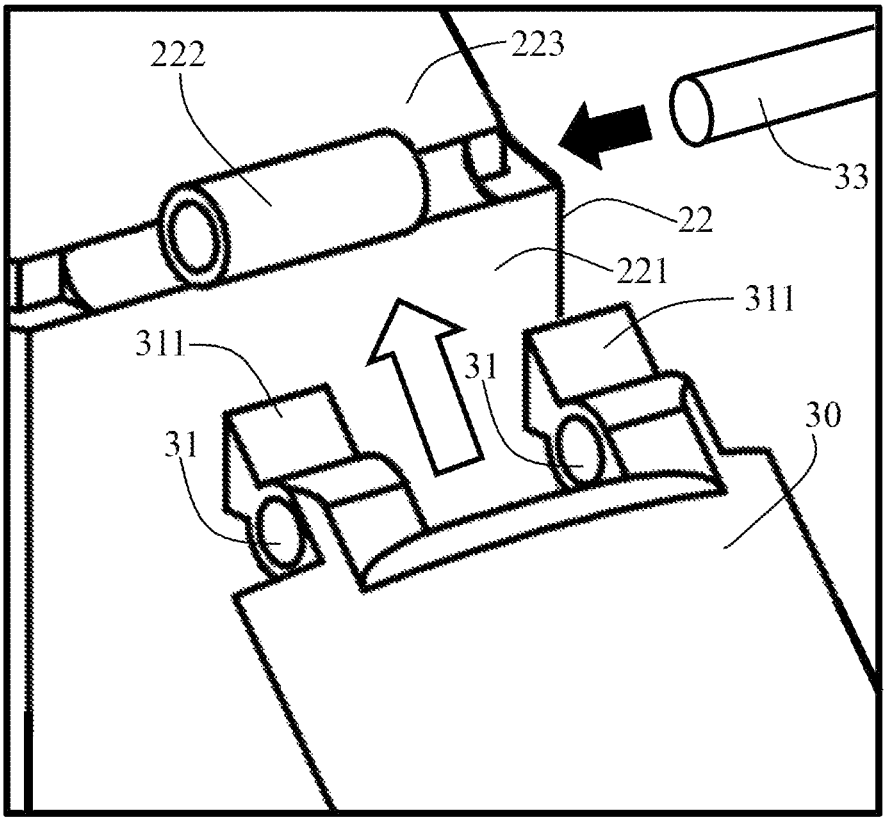
FIG. 9 illustrates how the foundation blade 30 is connected to the foundation body.

According to the present application, a number of the foundation blades 30 should be the same as that of the first upright sides 221. In this embodiment, there are 6 foundation blades 30. The foundation blades 30 are used to increase the bearing capacity of the root-like expandable foundation pile 1 when they are fully expanded. Refer to FIG. 7. It is a side view of the root-like expandable foundation pile 1 in a contracted status according to the present application. Before the root-like expandable foundation pile 1 is not used in the construction, the foundation blades 30 need to stay in the contracted status (all foundation blades 30 are close to the foundation body 20) to reduce storage space. And when the root-like expandable foundation pile 1 is driven to position, the foundation blades 30 also have to be in the contracted status in so that friction caused by the soil can be reduced. After the foundation blades 30 are expended, the weight of the superstructure transmitted through the foundation body 20 and the stopper 50 can be further dispersed to the foundation blades 30 to be carried by the soil beneath. As to the appearance and structure, see FIG. 8. FIG. 8 illustrates the foundation blade 30 in a front view (on the left) and a side view (on the right). All the foundation blades 30 are the same in appearance. Each foundation blade 30 has two second knuckles 31 on a swivel end 30*a* and a warped portion 32 protruding outward at an expanding end 30*b*. Refer to Fig. FIG. 9 illustrates how the foundation blade 30 is connected to the foundation body 20. The foundation blade 30 is rotatably connected to the top portion 22 by running a knuckle pin 33 through the second knuckles 31 and one of the first knuckles 222. First, move the foundation blade 30 to the top portion 22 of the foundation body 20 along the direction indicated by a hollow arrow and align the holes of the second knuckles 31 and the first knuckle 222. Secondly, insert the knuckle pin 33 through the second knuckles 31 and the first knuckle 222 along the direction indicated by a solid arrow.

Figure 10:
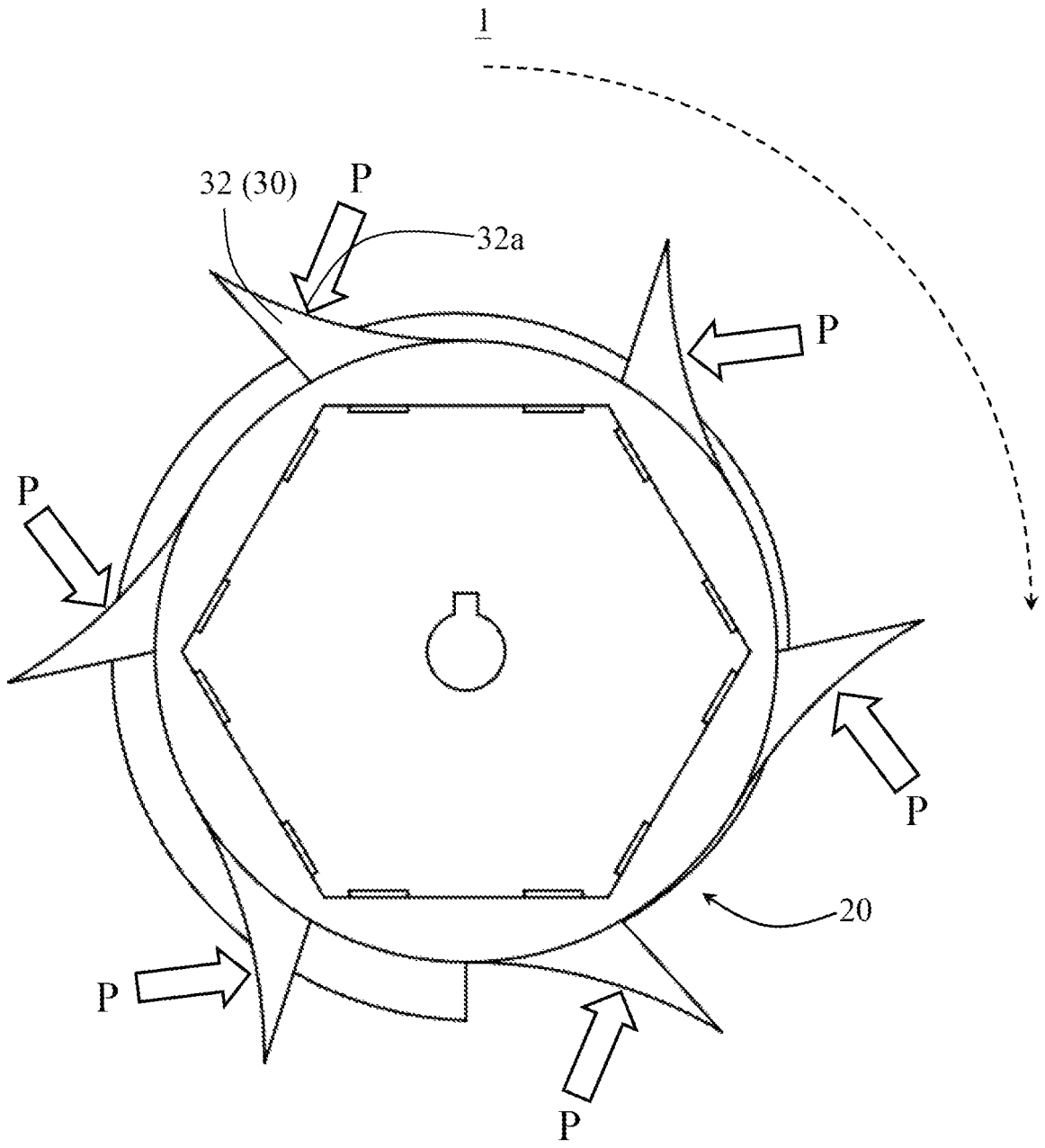
FIG. 10 is a top view of the root-like expandable foundation pile in, the contracted status according to the present application.
Figure 11:
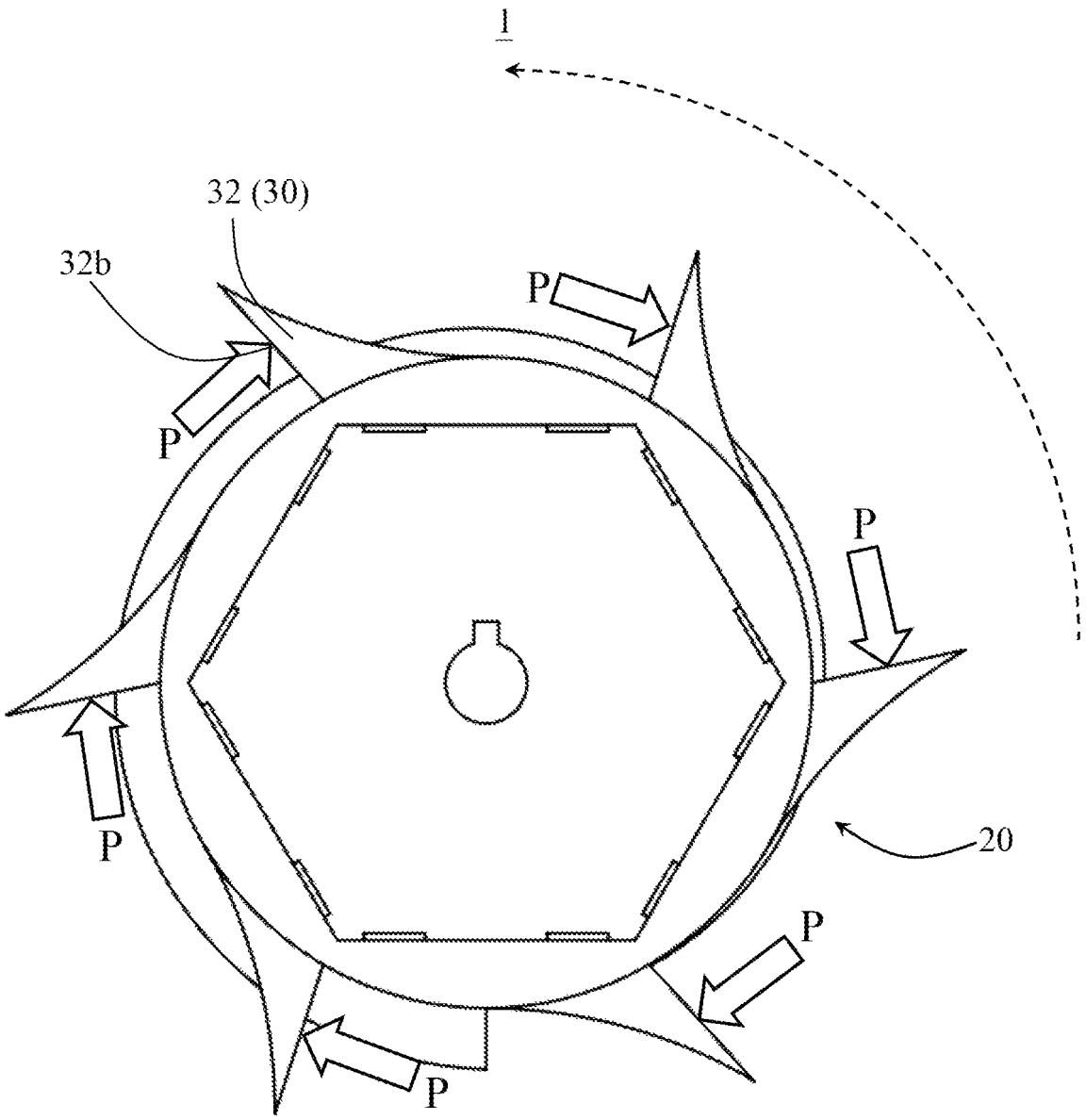
FIG. 11 illustrates the root-like expandable foundation pile turned in a reverse direction.
Figure 12:
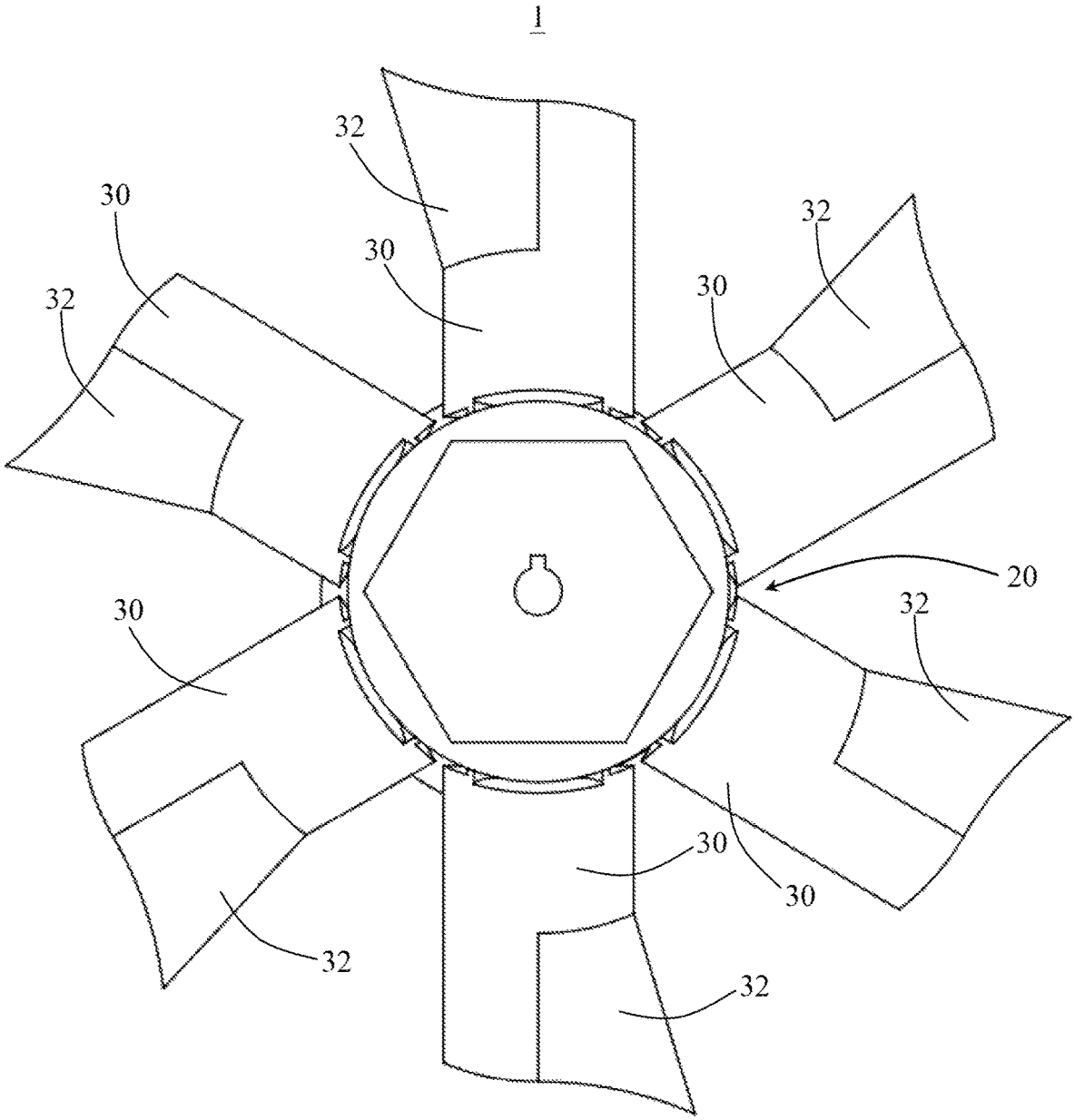
FIG. 12 is a top view of the root-like expandable foundation pile in the expanded status.

See FIG. 10. It is a top view of the root-like expandable foundation pile 1 in the contracted status according to the present application. All the foundation blades 30 are close to the foundation body 20 with the warped portions 32 protruding outward. When the root-like expandable foundation pile 1 is driven into the soil, it encounters two scenarios. When, the foundation body 20 rotates in the first direction (clockwise, along the direction of a curved dashed arrow line), the foundation blades 30 are close to one corresponding first upright side 221 by soil pressure P exerted on an external side 32*a* of the warped portion 32. In FIG. 11, the root-like expandable foundation pile 1 turned in a reverse direction is illustrated. When the foundation body 20 rotates in a second direction opposite (counterclockwise, along the direction of a curved dashed arrow line) to the first direction, the foundation blades 30 are rotated to expand from the corresponding first upright side 221 by soil pressure P exerted on an internal side 32*b* of the warped portion 32. After a few turns, the foundation blades 30 are all expanded to maximum by the soil pressure P exerted on the warped portion 32 as shown in FIG. 12 which is a top view of the root-like expandable foundation pile 1 in the expanded status. Preferably, an external side of the foundation blade 30, except the warped portion 32, is an arc surface. This design can make a peripheral shape when all foundation blades 30 are close to the foundation body 20 becomes a circle. A near-circular appearance of the root-like expandable foundation pile 1 in the contracted status can effectively reduce friction when it is rotated. Relatively, an internal side of the foundation blade 30, except the warped portion 32, is a flat surface. It makes the internal side of the foundation blade 30 fit the upright side 221 more neatly.

Figure 13:
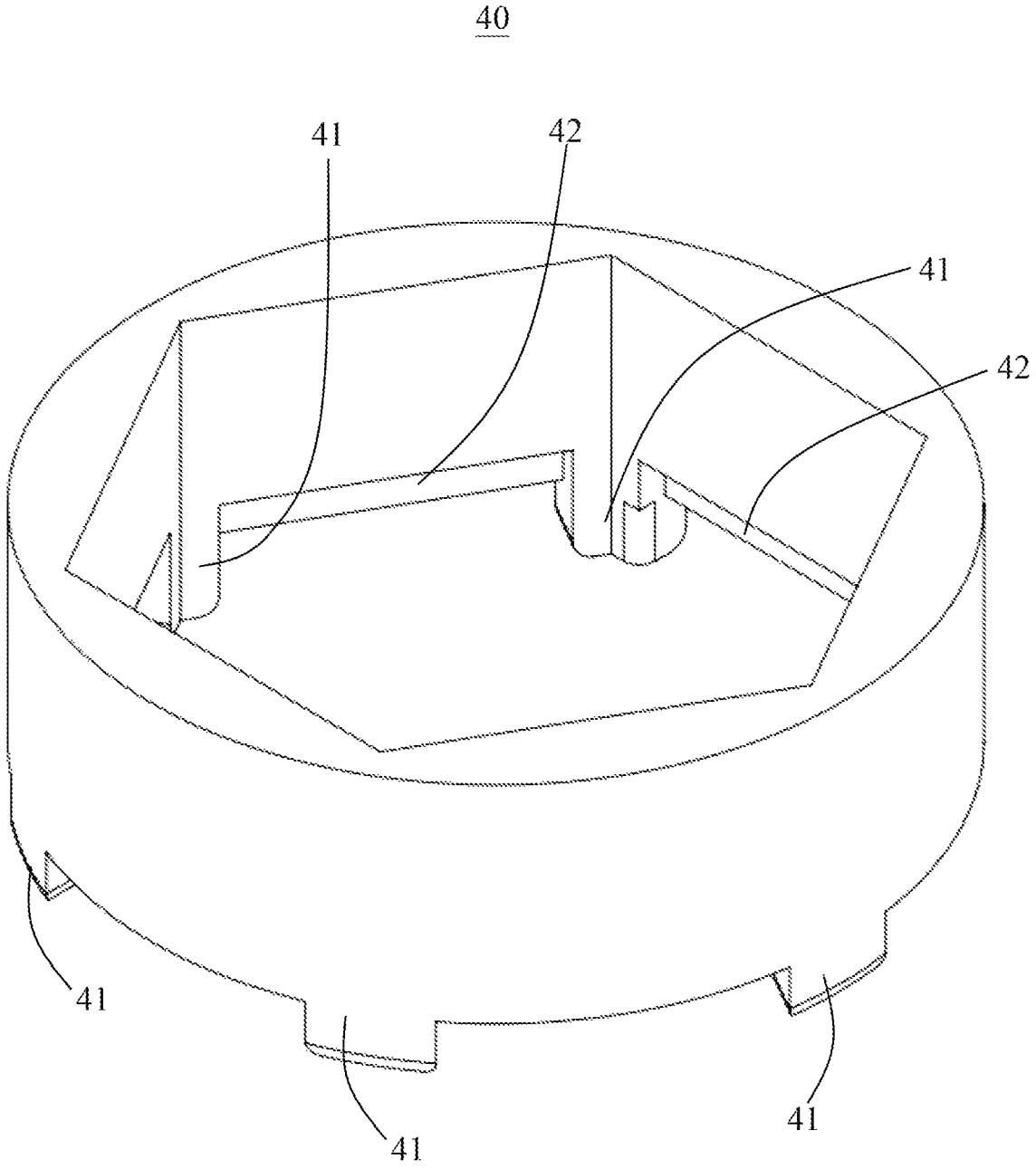
FIG. 13 is a stereogram of a foundation cap.

Refer to FIG. 13. FIG. 13 is a stereogram of the foundation cap 40. The foundation cap 40 is a tool to limit the movement of the knuckle pin 33 and rotate the foundation body 20 by a motor connected externally. As shown in FIG. 2, the foundation cap 40 is fixed on the top portion 22, for example, by welding. The foundation cap 40 has an outward appearance of a hollow cylinder with a number of connecting columns 41. As shown in FIG. 3, one connecting column 41 is connected to the top portion 22 at the location where an arrow points out. The location is also where central lines (dashed lines) of adjacent two knuckle pins 33 are intersected. With the connection of the connecting column 41 and the top portion 22, movement of one knuckle pin 33 can be limited by two adjacent connecting columns 41, and the knuckle pin 33 will not leave the second knuckle 31 and/or the first knuckle 222 to make the foundation blade 30 fall of the foundation body 20. There are 6 connecting columns 41 in the embodiment.

It is obvious from FIG. 13 that an internal section shape of the foundation cap 40 is the same as the regular polygon cross-sectional shape, namely, a regular hexagon. It is a feature to mount the stopper 50. Meanwhile, the foundation cap 40 can be connected to a motor (not shown) which provides power to rotate the foundation cap 40 and the foundation body 20 the foundation cap 40 is fixed to. The motor only has to equip a connector having a regular hexagon section, the same as the internal section shape of the foundation cap 40, on the end of a shaft of itself in this embodiment. A number of grooves 42 are formed on a bottom side of the foundation cap 40. Each groove 42 is parallel to one corresponding side of the internal section shape of the foundation cap 40. There are also 6 grooves 42. The groove 42 is used to make a room for fixing to the first knuckle 222 and two second knuckles 31 connected by the same knuckle pin 33.

Figure 14:
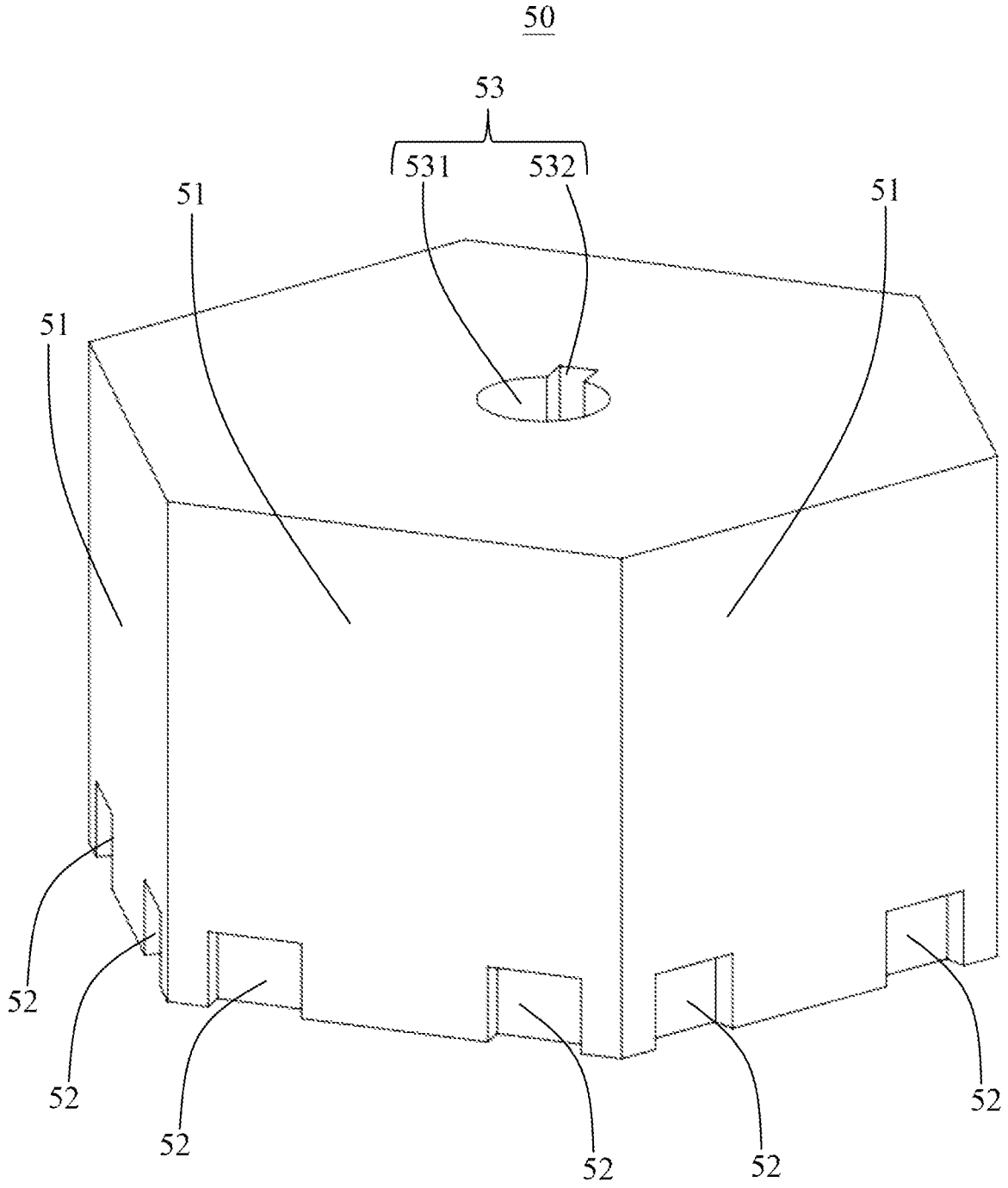
FIG. 14 is a stereogram of a stopper.

The stopper 50 is an element of the root-like expandable foundation pile 1 for linking to the base of a superstructure, e.g., a H-beam of a house. A motor can also indirectly rotate the foundation cap 40 and the foundation body 20 through the stopper 50. Refer to FIG. 14. It is a stereogram of the stopper 50. The stopper 50 has an outward appearance of a column with an external section shape the same as the regular polygon cross-sectional shape, a regular hexagon. Therefore, the stopper 50 can be tightly mounted inside the foundation cap 40 as shown in FIG. 1 and FIG. 2. The stopper 50 has a number of second upright sides 51. Since the external section shape is a regular hexagon, there are 6 second upright sides 51. Two indentations 52 are formed on a bottom end of each second upright side 51. Come back to FIG. 8 and FIG. 9. The second knuckle 31 further has a limit prism 311 formed on it. The limit prism 311 rotates with the second knuckle 33, passing through the indentation 52 and being stopped by touching a top surface 223 of the top portion 22, so that the foundation blade 30 may reach the maximum of expansion.

A second through hole 53 is formed through the stopper 50 in the center of the stopper 50. The control rod 11 can be inserted in the second through hole 53, capable of moving along and out of the second through hole 53 and being rotated synchronously with the stopper 50. As shown in FIG. 2, in the embodiment, the control rod 11 cannot fill up all the space since a part of the control rod 11 stay in the first through hole 23. However, the control rod 11 may be longer in other embodiments so that the end of the control rod 11 may reveal from the second through hole 53. The movable drill 10 may be de-coupled from the root-like expandable foundation pile 1 by pushing the end of the control rod 11. Like the first through hole 23, the second through hole 53 has a main portion 531 and a second limit portion 532. The main portion 531 can accommodate the main body of the movable drill 10 (the portion of the round rod). The second limit portion 532 is for accommodating the guide bar 13.

Material wise, all parts of the root-like expandable foundation pile 1 should use solid material. Preferably, the material may be stainless steel or alloy steel.

Figure 15:
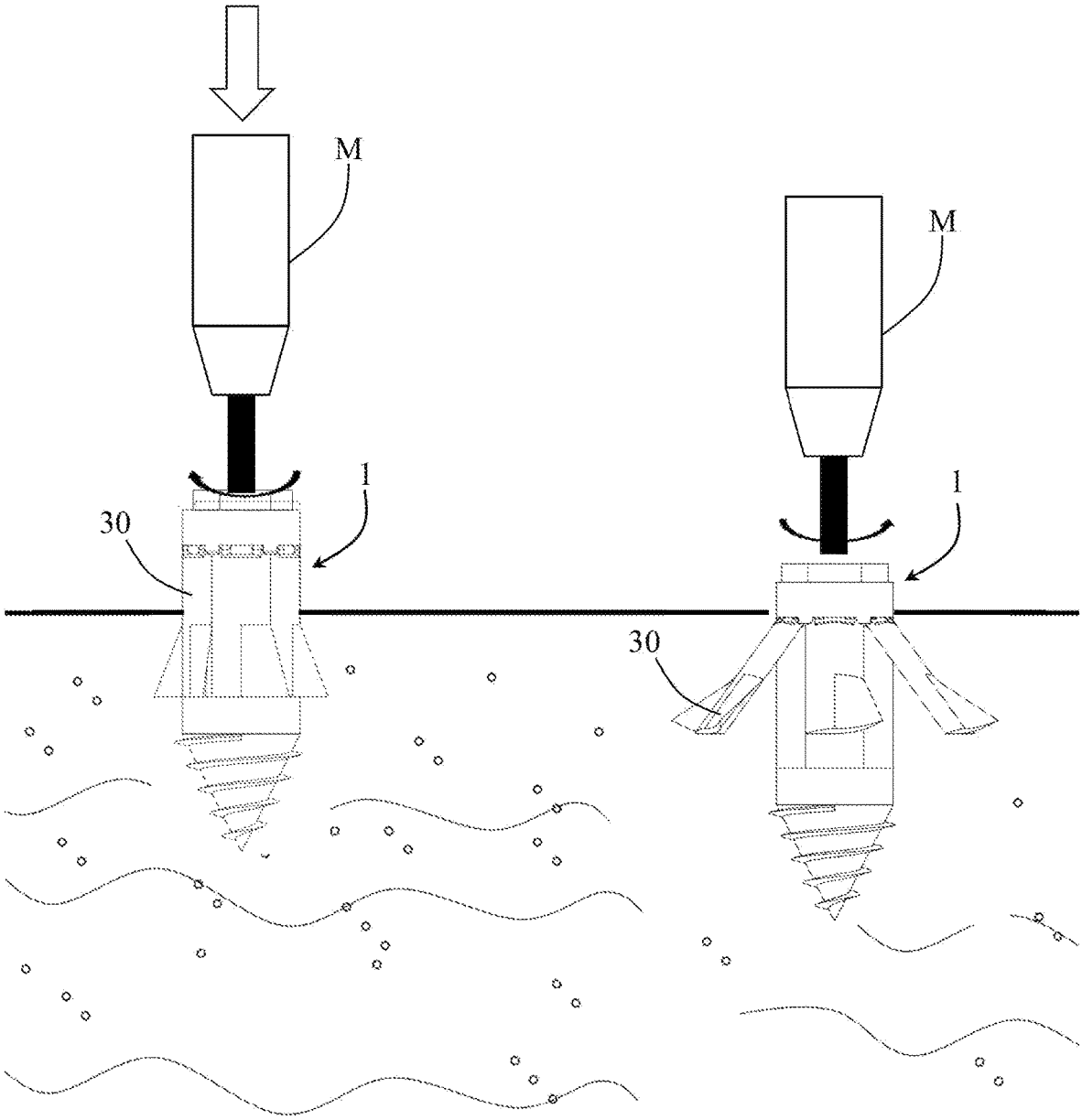
FIG. 15 illustrates installation of the root-like expandable foundation pile.

FIG. 15 illustrates installation of the root-like expandable foundation pile 1. In the left side of FIG. 15, it is the root-like expandable foundation pile 1 being driven into earth before reaching a predetermined depth. The root-like expandable foundation pile 1 is rotated and pushed by a motor M. It rotates clockwise. The foundation blades 30 is pushed by the earth on the warped portion 32. After the root-like expandable foundation pile 1 reach the predetermined depth, as shown in the right side of FIG. 15, the motor M begins to rotate counterclockwise. The foundation blades 30 are expanded. The root-like expandable foundation pile 1 will go deeper before the foundation blades 30 are fully expanded. The root-like expandable foundation pile 1 may settle further after the loading increases, until the maximum bearing capacity is developed.

Figure 16:
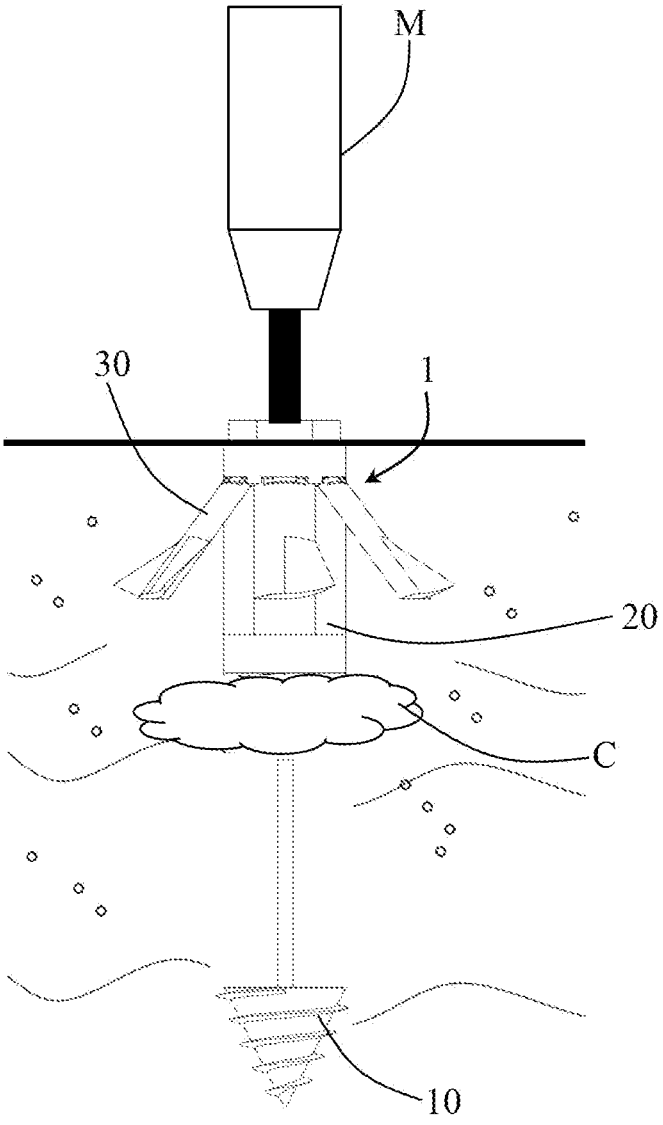
FIG. 16 illustrates foundation improvement with the root-like expandable foundation pile.

See FIG. 16. It illustrates foundation improvement with the root-like expandable foundation pile 1. If the soil is loose on the site of the root-like expandable foundation pile 1, the bearing capacity is not sufficient and a large settlement will happen, the root-like expandable foundation pile 1 can be used to conduct foundation improvement. As shown in FIG. 16, after the root-like expandable foundation pile 1 reaches a predetermined depth, the movable drill 10 is pushed out of the root-like expandable foundation pile 1. The other part of the root-like expandable foundation pile 1 will be pushed up relatively. Thus, the bottom of the first through hole 23 is open to the soil. Concrete C can be grouted through the second through hole 53 and the first through hole 23 to the space where the movable drill 10 leaves. The bearing capacity under the foundation body 20 can be improved.

While the present application has been described in terms of what is presently considered to be the most practical and preferred embodiments, it is to be understood that the present application needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A root-like expandable foundation pile, comprising:

a movable drill, comprising:

a control rod, having a guide bar parallelly formed thereon; and a conical drill bit, fixed on the end of the control rod, moving soil from a tip end to a tail end when being pushed and rotated in a first direction by the control rod;

a foundation body, comprising:

a bottom portion, having a circular cross-sectional shape; and a top portion, having a plurality of first upright sides and a regular polygon cross-sectional shape, wherein each first upright side has a first knuckle formed on a top side thereof, a first through hole is formed through the bottom portion and the top portion in the center of the foundation body, and the control rod is inserted in the first through hole, capable of moving along and out of the first through hole and being rotated synchronously with the foundation body;

a plurality of foundation blade, each having two second knuckles on a swivel end and a warped portion protruding outward at an expanding end, being rotatably connected to the top portion by running a knuckle pin through the second knuckles and one of the first knuckles, being close to one corresponding first upright side by soil pressure exerted on an external side of the warped portion when the foundation body rotates in the first direction, and being rotated to expand from the corresponding first upright side by soil pressure exerted on an internal side of the warped portion when the foundation body rotates in a second direction opposite to the first direction; and a foundation cap, fixed on the top portion, having an outward appearance of a hollow cylinder with a plurality of connecting columns, each connected to the top portion where central lines of adjacent two knuckle pins are intersected.

2. The root-like expandable foundation pile according to claim 1, wherein an internal section shape of the foundation cap is the same as the regular polygon cross-sectional shape, a plurality of grooves are formed on a bottom side of the foundation cap, and each groove is parallel to one corresponding side of the internal section shape of the foundation cap and used to make a room for fixing to the first knuckle and the two second knuckles connected by the same knuckle pin.

3. The root-like expandable foundation pile according to claim 2, further comprising a stopper having an outward appearance of a column with an external section shape the same as the regular polygon cross-sectional shape, tightly mounted inside the foundation cap, wherein the stopper has a plurality of second upright sides, and two indentations are formed on a bottom end of each second upright side.

4. The root-like expandable foundation pile according to claim 3, wherein the second knuckle further has a limit prism formed thereon, and the limit prism rotates with the second knuckle, passing through the indentation and being stopped by touching a top surface of the top portion, so that the foundation blade reaches the maximum of expansion.

5. The root-like expandable foundation pile according to claim 3, wherein a second through hole is formed through the stopper in the center thereof and the control rod is inserted in the second through hole, capable of moving along and out of the second through hole and being rotated synchronously with the stopper.

6. The root-like expandable foundation pile according to claim 5, wherein the second through hole further has a second limit portion for accommodating the guide bar.

7. The root-like expandable foundation pile according to claim 1, wherein the first through hole further has a first limit portion for accommodating the guide bar, so that when the foundation body rotates, the movable drill synchronously rotates due to the first limit portion pushing the guide bar to rotate.

8. The root-like expandable foundation pile according to claim 1, wherein an external side of the foundation blade, except the warped portion, is an arc surface.

9. The root-like expandable foundation pile according to claim 1, wherein an internal side of the foundation blade, except the warped portion, is a flat surface.

10. The root-like expandable foundation pile according to claim 1, wherein a number of the foundation, blades is the same as that of the first upright sides.

11. The root-like expandable foundation pile according to claim 1, wherein the regular polygon cross-sectional shape is regular triangle, square, regular pentagon, regular hexagon or regular octagon.

* * * * *